US007671730B2

(12) United States Patent
Henderson

(10) Patent No.: US 7,671,730 B2
(45) Date of Patent: Mar. 2, 2010

(54) AUTOMATED COMPUTERIZED ALARM SYSTEM

(76) Inventor: Penny S. Henderson, 995 Sunview Dr., Mogadore, OH (US) 44260

( * ) Notice: Subject to any disclaimer, the term of this patent is extended or adjusted under 35 U.S.C. 154(b) by 203 days.

(21) Appl. No.: 11/676,007

(22) Filed: Feb. 16, 2007

(65) Prior Publication Data

US 2008/0197999 A1 Aug. 21, 2008

(51) Int. Cl.
*G08B 1/00* (2006.01)

(52) U.S. Cl. ..... 340/531; 340/568.1; 340/426.1; 340/691.1; 340/506

(58) Field of Classification Search ..... 340/531, 340/539.1, 568.1, 571, 686.1, 686.6, 426.1, 340/539.26, 541, 691.1, 506
See application file for complete search history.

(56) References Cited

U.S. PATENT DOCUMENTS 4,521,645 A 6/1985 Carroll
4,641,127 A * 2/1987 Hogan et al. ..... 379/40
4,763,115 A 8/1988 Cota
5,012,507 A 4/1991 Leighton et al.
5,552,773 A * 9/1996 Kuhnert ..... 340/573.1
5,576,739 A 11/1996 Murphy
5,654,690 A 8/1997 Ishikawa et al.
5,801,627 A * 9/1998 Hartung ..... 340/568.1
6,215,404 B1 4/2001 Morales
6,529,128 B2 3/2003 Weng
6,762,686 B1 * 7/2004 Tabe ..... 340/573.1
6,774,802 B2 8/2004 Bachinski et al.
6,801,132 B2 10/2004 Clauss et al.
6,873,256 B2 3/2005 Lemelson et al.
7,005,994 B2 2/2006 King
7,043,237 B2 5/2006 Snyder et al.
7,126,467 B2 10/2006 Albert et al.
7,127,270 B2 10/2006 Sinclair
7,130,610 B2 10/2006 Dolezal et al.
2003/0038718 A1 2/2003 Clauss et al.
2005/0110632 A1 5/2005 Berezowski et al.
2006/0139160 A1 6/2006 Lin et al.
2006/0176169 A1 8/2006 Doolin et al.

* cited by examiner

*Primary Examiner*—Daniel Previl
(74) *Attorney, Agent, or Firm*—Hahn, Loeser & Parks, LLP; William S. Nabors

(57) ABSTRACT

An automatic alarm system has an alarm device having a sensor and a telephone having a telephone number. The telephone may be wireless. When the sensor senses a predetermined environmental indicator, the alarm device calls a receiver in a location separate from the alarm device to send an alarm. The receiver may identify the location of the alarm device by its telephone number or an identification code. The receiver can call the alarm device to confirm the alarm and monitor events around the alarm device. The alarm device may include a camera.

20 Claims, 7 Drawing Sheets

AUTOMATED COMPUTERIZED ALARM SYSTEM

BACKGROUND AND SUMMARY OF THE DISCLOSURE

The present invention relates to alarm systems, particularly automated alarm systems that communicate with monitoring centers in a separate location.

Many homes today have smoke detecting alarms that issue an audible alarm when the apparatus detects smoke. If a person is physically or mentally incapacitated, or a deep sleeper, or away from home, the smoke alarm alone may not be enough to save property and lives from fire. The household smoke alarm issues a warning, but does not notify the fire department or homeowner away from home.

Automated fire alarm systems have been known in security and fire alarm systems for large, wired installations. These alarm systems monitor commercial buildings or commercial locations for conditions such as smoke and high temperatures, and send a signal to a monitoring center in a separate location by dialing a modem or transmitting through a wired or wireless network. While these systems have furthered the art in alarm systems, these systems are expensive to install and maintain, making them beyond the reach of most home owners.

Further, once a sensor triggers an alarm, the monitoring center may wish to confirm the alarm before sending the fire department or police department. In a large commercial alarm installation, the monitoring center may call a guard on duty, or other selected person. In a home environment, however, there remains a need for confirming an alarm and identifying the location of the alarm on a widespread consumer basis.

An alarm system is provided comprising an alarm device positioned in a location and a receiver positioned in a second location separate from the alarm device. The alarm device comprises one or more sensors operatively responding to a predetermined environmental indicator by providing a sensor signal identifying the responding sensor; an alarm communication device connected to a communication network and having a telephone number for receiving calls on the communication network; and an alarm microprocessor operatively connected to the one or more sensors and the alarm communication device. The alarm microprocessor is capable of using the alarm communication device to call and operatively connect to the receiver after receiving the sensor signal and transmitting an alarm signal to the receiver correlating to the responding sensor. The receiver comprises a receiver communication device connected to the communication network and configured for operatively connecting to the alarm communication device over the communication network; and a receiver microprocessor operatively connected to the receiver communication device, the receiver microprocessor configured for receiving the alarm signal and identifying the location of the alarm device.

A method of alerting emergency services is disclosed comprising the steps of:

a. selecting a telephone number for an alarm device, the alarm device being positioned in a location;
b. sensing a predetermined environmental indicator by using one or more sensors;
c. calling automatically from the alarm device a receiver positioned in a second location separate from the alarm device;
d. transmitting an alarm signal from the alarm device to the receiver; and e. identifying the location of the alarm device by the telephone number.

The alarm system and method of alerting emergency services may be capable of responding to environmental indicators such as smoke, carbon monoxide, carbon dioxide, ozone, temperature, and combustible gas.

The receiver of the alarm system may call the alarm device by dialing the telephone number and creating a voice communication channel between the alarm device and the receiver.

The alarm system may further include a camera, and the receiver may call the alarm device by dialing the telephone number and receive the video signal on a display device.

DETAILED DESCRIPTION OF THE DISCLOSURE

Figure 1:
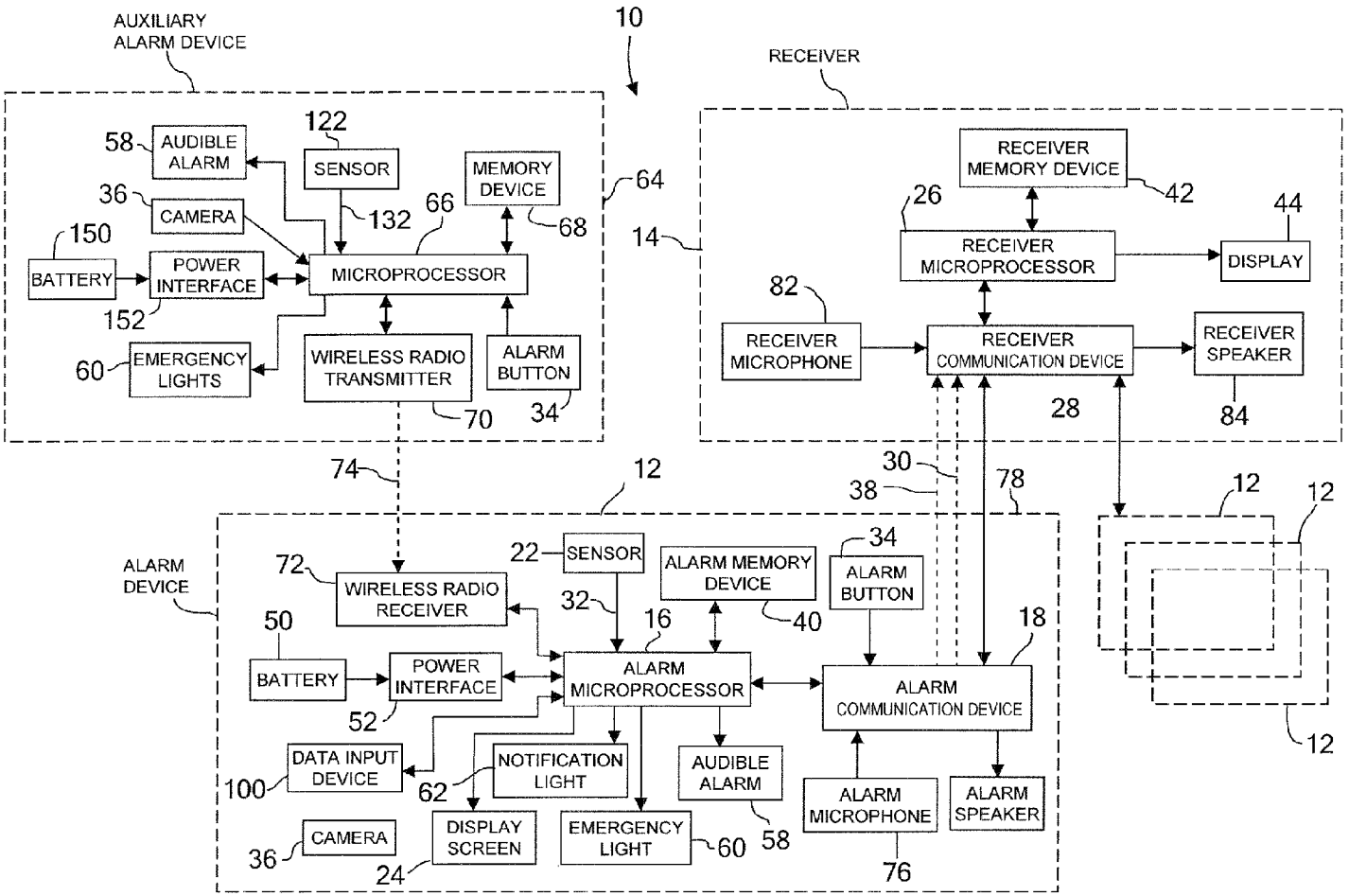
FIG. 1 is a block diagram of an alarm system of the present disclosure.
Figure 2:
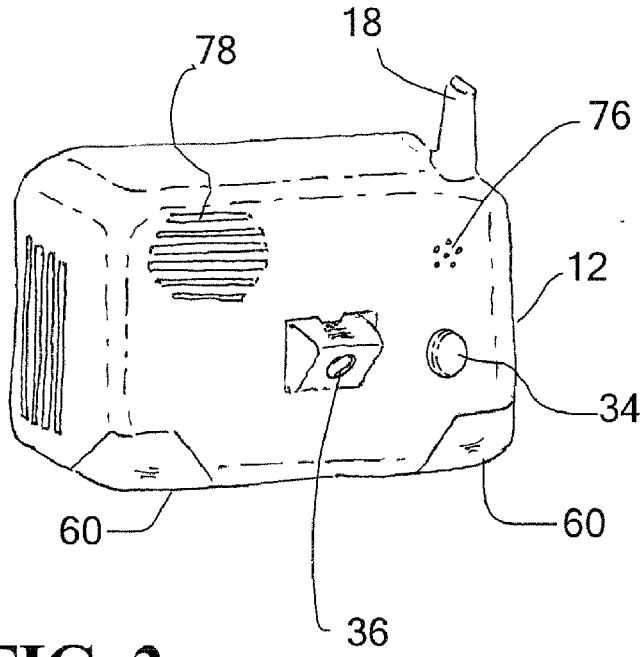
FIG. 2 is a front perspective view of an alarm device of the present disclosure.

Referring now to FIG. 1, an alarm system 10 is provided. The alarm system 10 comprises an alarm device 12, and a receiver 14. The alarm device 12 is positioned in a desired location such as a home, an office, or other locations. The receiver 14 may be maintained at a monitoring center at a location away from the alarm device 12. The receiver 14 may be positioned and monitored in a location separate from the alarm device such as a township fire department, or a commercial call center, a 9-1-1 call center, or another similar location where the receiver 14 may be monitored by an operator.

Figure 4:
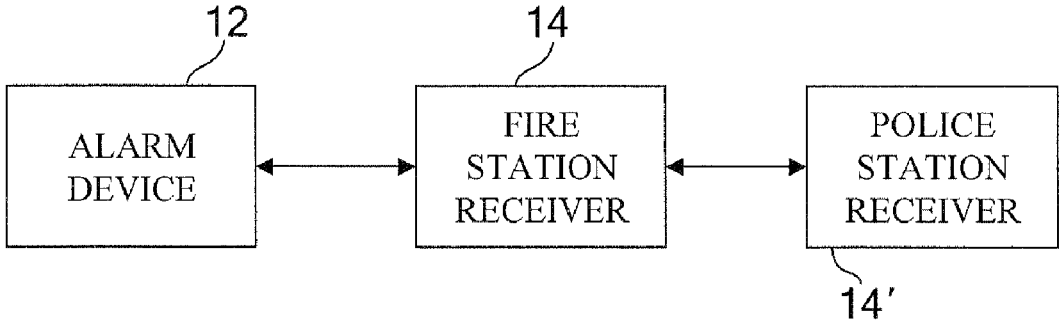
FIG. 4 is a block diagram of an alarm system of the present disclosure.

The alarm system 10 may be a regional system, with one receiver 14 monitoring a plurality of alarm devices 12, where each alarm device 12 may be located at a different household address. One or more receivers 14 may be located at a township fire department or police department and configured to monitor alarm devices 12 installed in homes in the township. As indicated by FIG. 4, the alarm device 12 may be programmed to call the receiver 14 located in a location such as a fire department, and the receiver 14 may call a second receiver 14' located in a location such as a police department.

The alarm device 12 comprises an alarm microprocessor 16 operatively connected to an alarm communication device 18, such as, but not limited to, a telephone, connected to a communication network. The communication network may be a wired or wireless telephone network. The communication network may be a cable or internet network. In one embodiment, the alarm communication device 18 has a telephone number for receiving calls. The alarm device 12 may have one or more sensors 22, such as a smoke detecting sensor and a carbon monoxide detecting sensor.

The receiver 14 comprises a receiver microprocessor 26 operatively connected to a receiver communication device 28, such as, but not limited to, a telephone, connected to the communication network.

When an alarm device 12 detects smoke or another environmental indicator, the alarm device 12 uses the alarm communication device 18 to call the receiver communication device 28 for operatively connecting to the receiver 14 and transmitting an alarm signal 30. The receiver 14 receives the alarm signal 30, and determines the location of the alarm device 12. The receiver 14 may determine the location of the alarm device 12 by the telephone number of the alarm communication device 18. Alternately, an identification code for identifying the location of the alarm device 12 may be included in or with the alarm signal 30. The receiver 14 may then disconnect the call, and then reconnect to the alarm device 12 by dialing the telephone number of the alarm communication device 18 to confirm the emergency before dispatching appropriate assistance.

The alarm communication device 18 may be connected to the communication network, and may have its own telephone number for receiving calls on the communication network. In this application and the appended claims, the words "telephone" and "telephonic" mean any hardware or software device or system for transferring voice, images, video, alarm signals, and data across a communication network. The alarm communication device 18 may be a telephone such as a wireless telephone or a wireless device connected over a wireless communication network, such as a mobile telephone network known in the art. Optionally, the alarm communication device 18 may be a two-way radio. The communication network may be a telephone network. The communication network may be a cable or internet network. Any communication network may be used for connecting the alarm device 12 to the receiver 14.

Each sensor 22 may be configured to operatively respond to a predetermined environmental indicator by providing a sensor signal 32 identifying the responding sensor. The alarm device 12 may include sensors 22 configured for responding to environmental indicators including, but not limited to, smoke, carbon monoxide, carbon dioxide, ozone, temperature, and combustible gas.

The alarm device 12 may comprise a smoke sensor and a carbon monoxide sensor. In this embodiment, for example, when the smoke sensor detects a predetermined amount of smoke in the environment around the alarm device 12, the smoke sensor provides a smoke sensor signal to the alarm microprocessor 16. And, for example, when the carbon monoxide sensor detects a predetermined amount of carbon monoxide in the environment around the alarm device 12, the carbon monoxide sensor provides a carbon monoxide sensor signal to the alarm microprocessor 16. In this embodiment, each responding sensor 22 has a different sensor signal 32 for identifying the responding sensor 22, allowing the alarm microprocessor 16 to distinguish between a smoke alarm, a carbon monoxide alarm, and other alarms. Optionally, each sensor 22 may provide the same sensor signal 32 to the alarm microprocessor 16. The sensor signal 32 may comprise an analog or digital signal.

The sensors 22 may be positioned within the alarm device 12. Alternately, the sensors 22 may be positioned in a separate device or unit in communication with the alarm device 12 and configured for communicating the alarm signal 30 to the alarm microprocessor 16. The sensors 22 may have microprocessors and associated electronics to provide a sensor signal 32.

Figure 5:
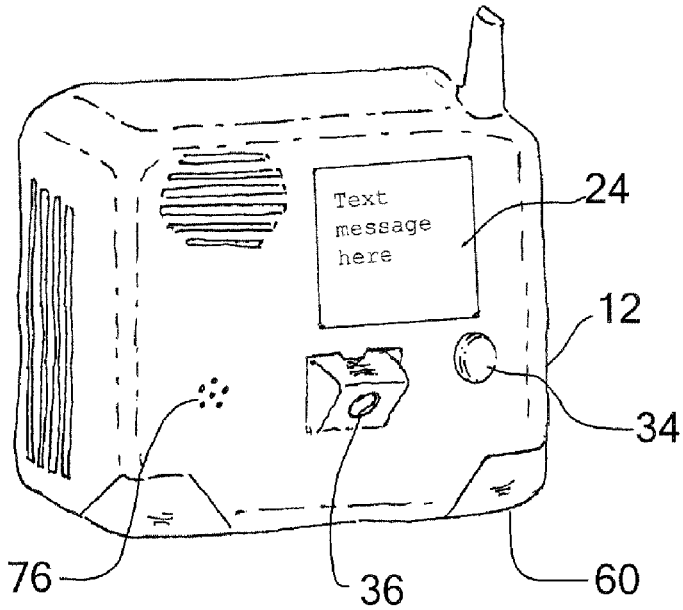
FIG. 5 is a front perspective view of an embodiment of an alarm device of the present disclosure.
Figure 6:
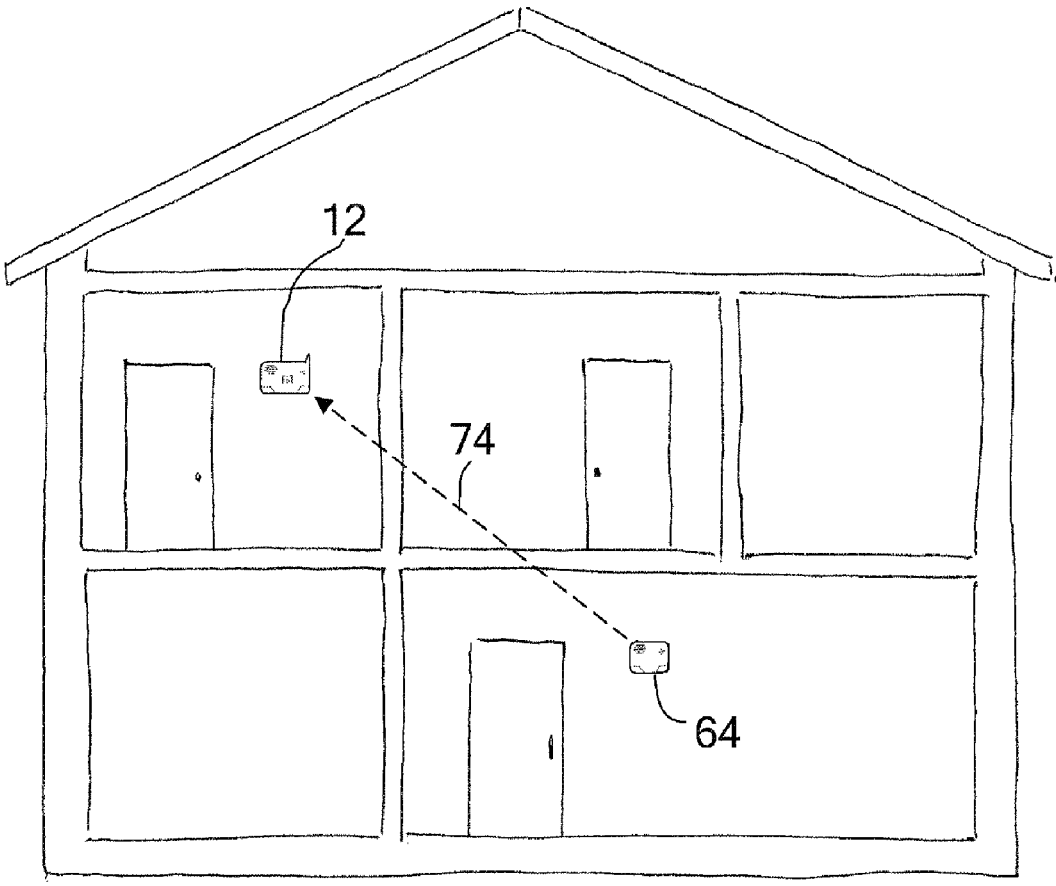
FIG. 6 is a partial front view of a home with the alarm device of FIG. 2.

The alarm device 12 may have a display screen 24 as indicated in FIG. 5 that displays an alert when a sensor 22 provides a sensor signal 32. Various status information may be displayed on the display screen, such the amount of power left in the battery, information about the responding sensor 22, or other information. The display screen 24 may display other information, such as the time and date.

In one method, the alarm system 10 includes the steps of:

selecting a telephone number for the alarm device 12;

sensing a predetermined environmental indicator using sensors 22 in the alarm device 12;

the alarm device 12 calling automatically to the receiver 14 positioned in a second location separate from the alarm device 12;

transmitting the alarm signal 30 from the alarm device 12 to the receiver 14; and the receiver 14 identifying the location of the alarm device 12 by the telephone number.

Alternately, the method includes the step of the receiver 14 identifying the location of the alarm device 12 by an identification code transmitted with, or as a part of, the alarm signal 30.

When the alarm microprocessor 16 receives the sensor signal 32, the alarm microprocessor 16 calls the receiver 14 using the alarm communication device 18 to send the alarm signal 30. The alarm signal 30 may identify the responding sensor 22 based on the sensor signal 32.

The alarm device 12 may use the alarm communication device 18 to call a predetermined telephone number, such as the telephone number of a neighbor or family member, or the telephone number of a property owner. The alarm device 12 may call the predetermined telephone number before, or, if desired, after, calling the receiver 14. The alarm device 12 may provide a pre-recorded message or other communication when the alarm device 12 calls the predetermined telephone number.

The alarm device 12 may include an alarm button 34. The alarm button 34 may be operatively connected to the alarm microprocessor 16, and configured so that when the alarm button 34 is pressed, the alarm microprocessor 16 calls the receiver 14 using the alarm communication device 18 to send the alarm signal 30. The alarm device 12 may be used to report emergencies by pressing the alarm button 34. In an emergency, such as a health emergency, disturbance, or other emergency, a person may press the alarm button 34 to send the alarm signal 30 to the receiver 14. In public areas, such as around shopping centers and automated banking machines, or ATM machines, the alarm devices 12 may be positioned in accessible locations for persons to report emergencies by pressing the alarm button 34.

The alarm button 34 on the alarm device 12 may be configured for ease of visibility, such as, for example, the button having a color, size and lighting determined to be visible. For example, an alarm device 12 placed in a public area may have the alarm button diameter between 1 to 4 inches, and a household alarm may have a button diameter that is between ¼ to 1 inch or more. The alarm button 34 may have a colored light inside the button so that the button is illuminated at night. The alarm button 34 may be covered by a removable cover to reduce accidental pressing.

A household telephone or wireless mobile telephone may be integrated into the alarm system 10. A telephone such as a wireless mobile telephone or a household telephone may be provided with the alarm button 34. In this embodiment, the household or wireless telephone may be the alarm communication device 18. The telephone with the alarm button 34 may be programmed so that when a user presses the alarm button 34, the alarm communication device 18, or household or wireless telephone in this case, calls the receiver 14 and transmits the alarm signal 30. Alternately, the telephone with the alarm button 34 may be programmed to call an alarm device 12, such as the alarm device 12 located at the user's home. When the telephone calls the alarm device 12, the telephone with the alarm button 34 may be programmed to send the alarm signal 30 to the alarm device 12, which in turn may call the receiver 14. The location of the wireless telephone may be communicated to the receiver 14 by location identification methods and devices such as global positioning systems (GPS), triangulation of the signal from three proximate towers, or another method or device, including verbal communication over the alarm communication device 18.

The alarm device 12 may comprise a camera 36 operatively connected to and controlled by the alarm microprocessor 16. When the alarm microprocessor 16 receives the sensor signal 32, video images may be recorded by the camera 36, creating a video signal 38 that may be buffered in an alarm memory device 40.

Figure 3:
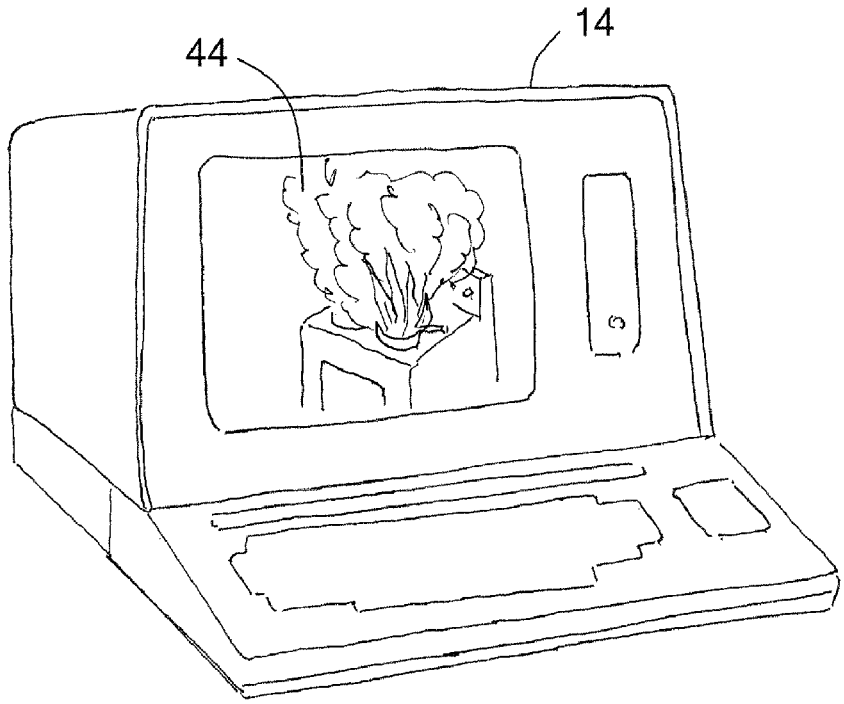
FIG. 3 is a front perspective view of an alarm receiver of the present disclosure.

The video signal 38 may be transmitted to the receiver 14 when the alarm communication device 18 and the receiver communication device 28 are operatively connected. The video signal 38 may be stored in a receiver memory device 42. The video signal 38 may be output to a display 44 as illustrated in FIG. 3.

The video signal 38 may comprise a series of still photographs taken at a predetermined interval, or frame rate. The photographs may be taken at 2 second intervals. Alternately, the photographs may be taken at 0.13 second intervals, or about 8 frames per second. The photographs may be taken at faster or slower intervals or frame rates. Optionally, the alarm microprocessor 16 may be programmed to control the camera 36 frame rate, and the frame rate may be selected based on the ability of the communication network to transfer the video signal 38 and the quality of the connection between the alarm communication device 18 and the receiver communication device 28.

The alarm device 12 may be powered by a battery 50, such as a 9 volt battery. A power interface 52 may operatively configure the voltage and current amperage for the alarm microprocessor 16, alarm communication device 18, and other components. The alarm device 12 may be plugged into the household electricity, such as a 120 volt alternating current system known in the United States. In a 120 volt embodiment, the battery 50 may be provided as a back-up in case of a power outage.

In the embodiment of FIG. 1, the alarm device 12 includes an audible alarm 58 sounding when the alarm microprocessor 16 receives the sensor signal 32. The audible alarm 58 may provide a different sound for each responding sensor 22 based on the sensor signal 32. When the alarm device 12 has at least two sensors, the audible alarm 58 may provide a different sound for each responding sensor 22. The audible alarm 58 may be a sound within a range of about 80 to 120 decibels. The audible alarm 58 may have one or more tones. Alternately, the audible alarm 58 may be a pre-recorded voice message.

The alarm device may have one or more emergency lights 60 turning on when the alarm microprocessor 16 receives the sensor signal 32. The emergency lights 60 may be bright lights for providing light for persons to see within an area, or to guide persons to an exit.

Alternately, the emergency lights 60 may comprise two or more colors, such as red and green. In a colored light embodiment, the emergency lights 60 may have a red color to indicate an environmental condition, such as high temperature. In a temperature sensing embodiment, the alarm device may be positioned on a door or a wall, where the sensor 22 may indicate high temperature on the other side of the door or wall, such as due to flames, whereupon the emergency light 60 would illuminate red. The emergency light 60 may illuminate green when no emergency is detected.

Figure 7:
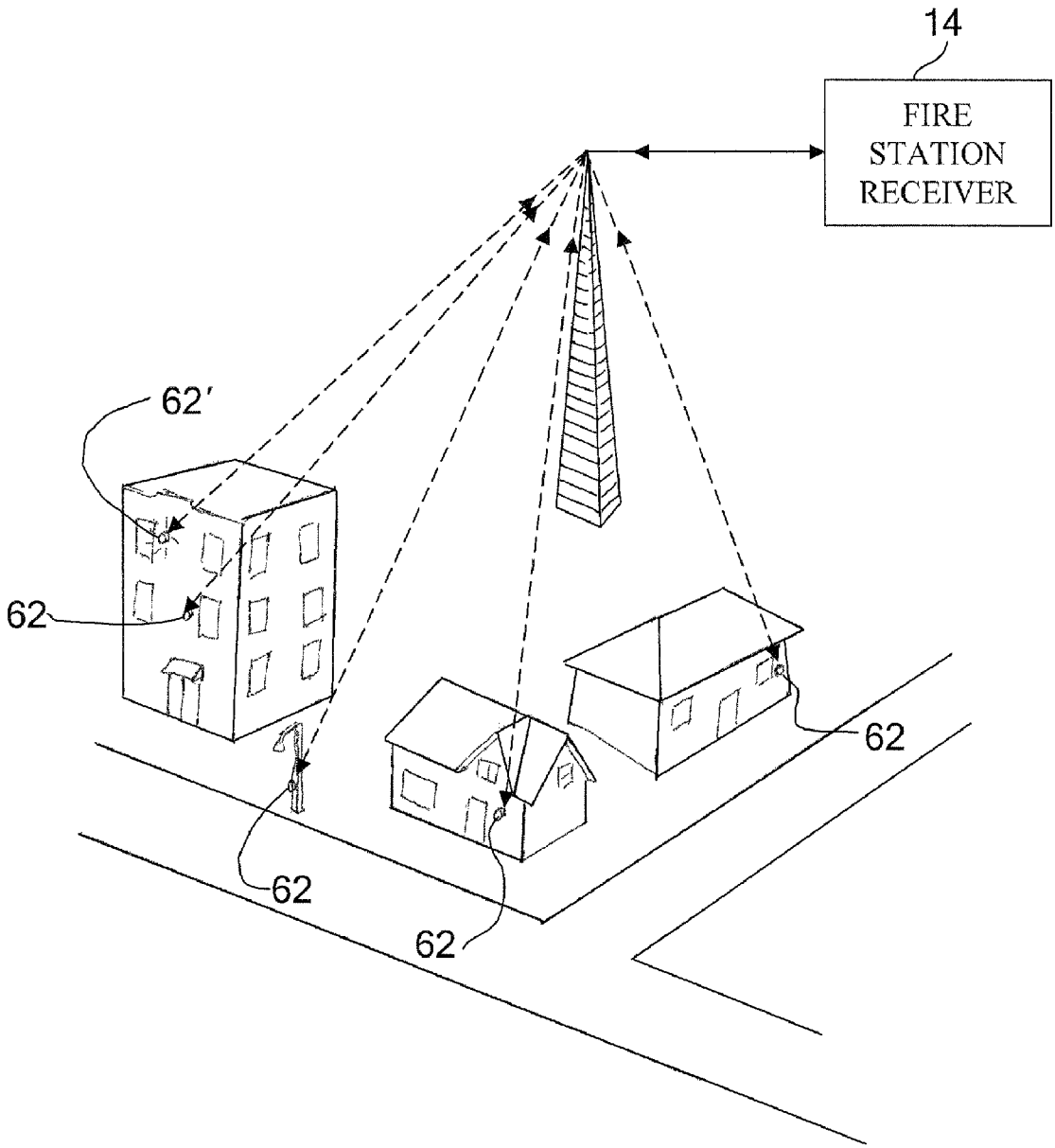
FIG. 7 is a perspective view of a geographic area using alarm notification lights of the present disclosure.

The alarm system may include notification lights 62, operatively connected to the alarm device 12. The notification lights 62 may be located at each address where an alarm device is installed, and visible from the street, as illustrated by FIG. 7. When the alarm device 12 calls the receiver 14 using the alarm communication device 18 to send the alarm signal 30, the notification lights 62 may be automatically illuminated by the alarm microprocessor 16, indicated by 62' in FIG. 7.

As shown in FIGS. 1 and 4, the alarm system 10 may comprise an auxiliary alarm device 64. The auxiliary alarm device 64 comprises one or more sensors 122 operatively connected to a microprocessor 66. The auxiliary alarm device 64 may be used when a home or other area is too large for one alarm device 12 to monitor effectively. In this embodiment, one or more auxiliary alarm devices 64 may be positioned within a predetermined distance from the alarm device 12 for providing additional sensors around a location.

In the embodiment of FIG. 1, the auxiliary alarm device 64 comprises a memory device 68 and a wireless radio transmitter 70 operatively connected to the microprocessor 66. In this embodiment, the alarm device 12 includes a corresponding wireless radio receiver 72 operatively connected to the alarm microprocessor 16. The radio transmitter 70 has a transmission range at least the predetermined distance from the alarm device 12. The radio transmitter 70 and radio receiver 72 may be configured to transmit a wireless signal by any suitable radio or wireless standard, including but not limited to the Institute of Electrical and Electronics Engineers 802.11 and 802.15.4 standards known in the art. Alternately, the auxiliary alarm device 64 may be connected to the alarm device 12 by a wire.

The radio transmitter 70 may use a wireless telephone frequency such as a 2.4 GHz frequency standard used by certain home telephones. In a 2.4 GHz embodiment, the radio transmitter 70 may be configured to call the receiver 14 through the 2.4 GHz home telephone.

When the sensor 122 in the auxiliary alarm device 64 detects a predetermined environmental indicator such as smoke, the sensor 122 provides the sensor signal 132 to the microprocessor 66. The microprocessor 66 sends the sensor signal 132 as a wireless alarm signal 74 through the radio transmitter 70 to the radio receiver 72. The alarm microprocessor 16 operatively receives the wireless alarm signal 74 from the radio receiver 72 and uses the alarm communication device 18 to operatively connect to the receiver 14 positioned in the location separate from the alarm device 12.

The auxiliary alarm device 64 may include the alarm button 34 operatively connected to the microprocessor 66. In this embodiment, when the alarm button 34 is pressed, the microprocessor 66 sends the wireless alarm signal 74 through the radio transmitter 70 to the radio receiver 72, and the alarm device 12 sends the alarm signal 30 to the receiver 14.

In the embodiment if FIG. 1, the auxiliary alarm device 64 includes the camera 36, the audible alarm 58, and one or more emergency lights 60. The auxiliary alarm device 64 may include the display screen 24.

The auxiliary alarm device 64 may be powered by a battery 150, such as a 9 volt battery. A power interface 152 may operatively configure the voltage and current for the microprocessor 66, radio transmitter 70, and other components. The auxiliary alarm device 64 may be plugged into the household electricity, such as a 120 volt alternating current system known in the United States. In a 120 volt embodiment, the battery 150 may be provided as a back-up in case of a power outage.

The alarm device 12 may be operatively connected to other systems or devices, such as fans, vents, filters, pumps, power generators, and other emergency devices. For example, when the sensor 22 detects the presence of smoke or carbon monoxide, the alarm microprocessor 16 may be capable of turning on a vent (not shown) for venting smoke or carbon monoxide out of the building. The vent may be a fan or blower or other device capable of moving contaminated air to the outside of the building through a chimney or other vent or opening. For example, when the alarm device detects a power outage, the alarm microprocessor 16 may be capable of turning on a power generator (not shown).

In the embodiment of FIG. 1, the alarm communication device 18 includes an alarm microphone 76 and an alarm speaker 78, and the receiver communication device 28 includes a receiver microphone 82 and receiver speaker 84. In this embodiment, the receiver microprocessor 26 may use the receiver communication device 28 to call and operatively connect to the alarm device 12 by dialing the telephone number, thereby creating a communication channel between the alarm device 12 and the receiver 14. Then, an operator at the receiver 14 may listen from the receiver speaker 84 to the sounds adjacent to the alarm device 12 that are received by the alarm microphone 76. The operator may talk through the receiver microphone 82 and alarm speaker 78 to persons adjacent to the alarm device 12. The receiver 14 may transmit a pre-recorded voice message over the alarm speaker 78.

In an embodiment with voice communication and the camera 36, the operator at the receiver 14 may both talk to persons adjacent to the alarm device 12 and view a video image of the scene on the display 44.

A property owner or other person may call the alarm device 12 by dialing the telephone number of the alarm communication device 18 from a telephone on the communication network. The property owner or other person may listen through the telephone to the sounds adjacent the to the alarm device 12 that are received by the alarm microphone 76. The person may talk through the telephone to persons adjacent to the alarm device 12 using the alarm microphone 76 and alarm speaker 78. Certain functions of the alarm device 12 may be controlled by the property owner or other person who calls the alarm device 12, such as turning the device on and off, or deactivating a false alarm, or other functions.

Figure 8:
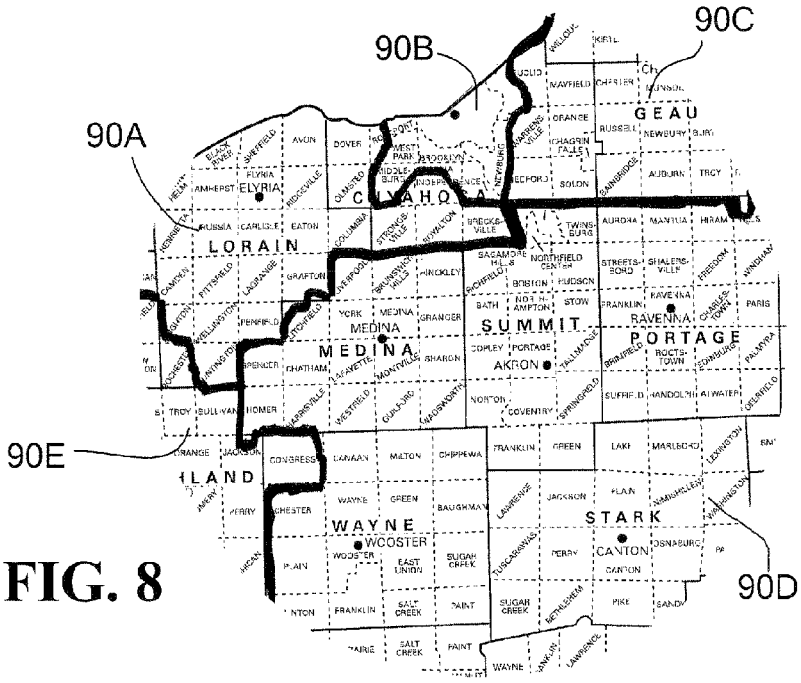
FIG. 8 is a partial plan view of an area code map.
Figure 9:
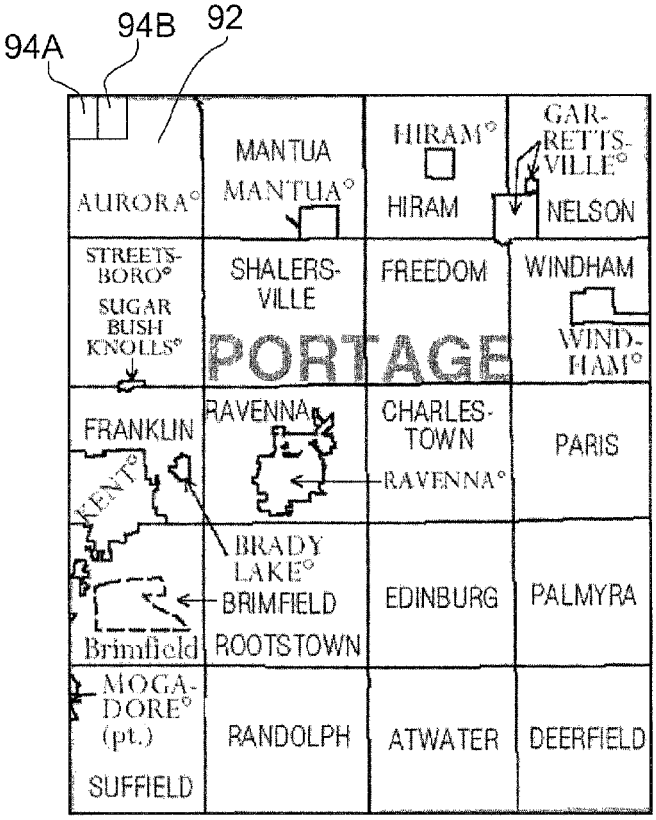
FIG. 9 is a partial plan view of a county map showing townships.

The telephone number may identify the location of the alarm device. The telephone number may be selected to identify the location of the alarm device 12 by the sequence of numbers in the telephone number. Telephone numbers in the United States are typically ten digits, the first three digits being an area code. As indicated in FIG. 8, a geographic area is typically divided into area code areas 90. The remaining seven digits may be selected to indicate a township 92 and a geographic area 94 within the township 92. In this embodiment, when the receiver 14 operatively connects to the alarm device 12, the receiver microprocessor 26 identifies the geographic area 94 within the area code area 90 where the alarm device 12 is located by decoding the sequence of telephone number digits. In this way, the monitoring center receiving the alarm signal 30 immediately knows at least the geographic area 94 location of the calling alarm device 12. The receiver 14 may identify the telephone number of the alarm device 12 by using caller identification techniques known in the art. Alternately, the alarm device 12 may transmit the telephone number or identification code to the receiver 14 with, or as a part of, the alarm signal 30.

A map of the geographic area 94 may be viewed by the operator at the receiver 14. The map may indicate where the responding sensor is located and may generate directions for responding emergency personnel to use to go to the address of the alarm.

The telephone number may be supplemented with additional digits or an additional identification code. Additional digits may be used for the receiver 14 and the telephone company for identifying that the call is from an alarm device 12 of the alarm system 10. For example, the alarm system may use digits such as *37 or other digits for the receiver 14 and the telephone company to distinguish the alarm call from other calls.

The additional digits or identification code may also be used for identifying the location of the alarm device 12. Alternately, the alarm signal 30 comprises the identification code for identifying the location of the alarm device 12. The identification code may include the property address, or information defining the township where the alarm device is installed. The identification code may include any identifying sequence, such as, but not limited to, a township and area identification used in the Public Land Survey System. Additional digits may be used to further refine the location of the alarm device 12 in the geographic area 94, such as by township section, by city block, or by parcel.

The receiver microprocessor 26 may be operatively connected to a database, where the database associates the telephone number or identification code with at least an address where the alarm device is located. When the receiver 14 operatively connects to the alarm device 12 and receives the alarm signal 30, the receiver microprocessor 26 may identify the location of the alarm device 12 by accessing the database associating the telephone number or identification code with at least an address where the alarm device is located. When the receiver microprocessor 26 receives the telephone number or identification code, the receiver microprocessor 26 retrieves the address associated with the telephone number or identification code from the database.

In one database embodiment, additional information may be associated with the telephone number or identification code. The database record may include names of persons who normally occupy the address. Additionally, other information that may assist emergency personnel may also be associated with the telephone number or identification code, such as, but not limited to, medical information of occupants, or inventories of hazardous materials or conditions maintained at the address.

Figure 10:
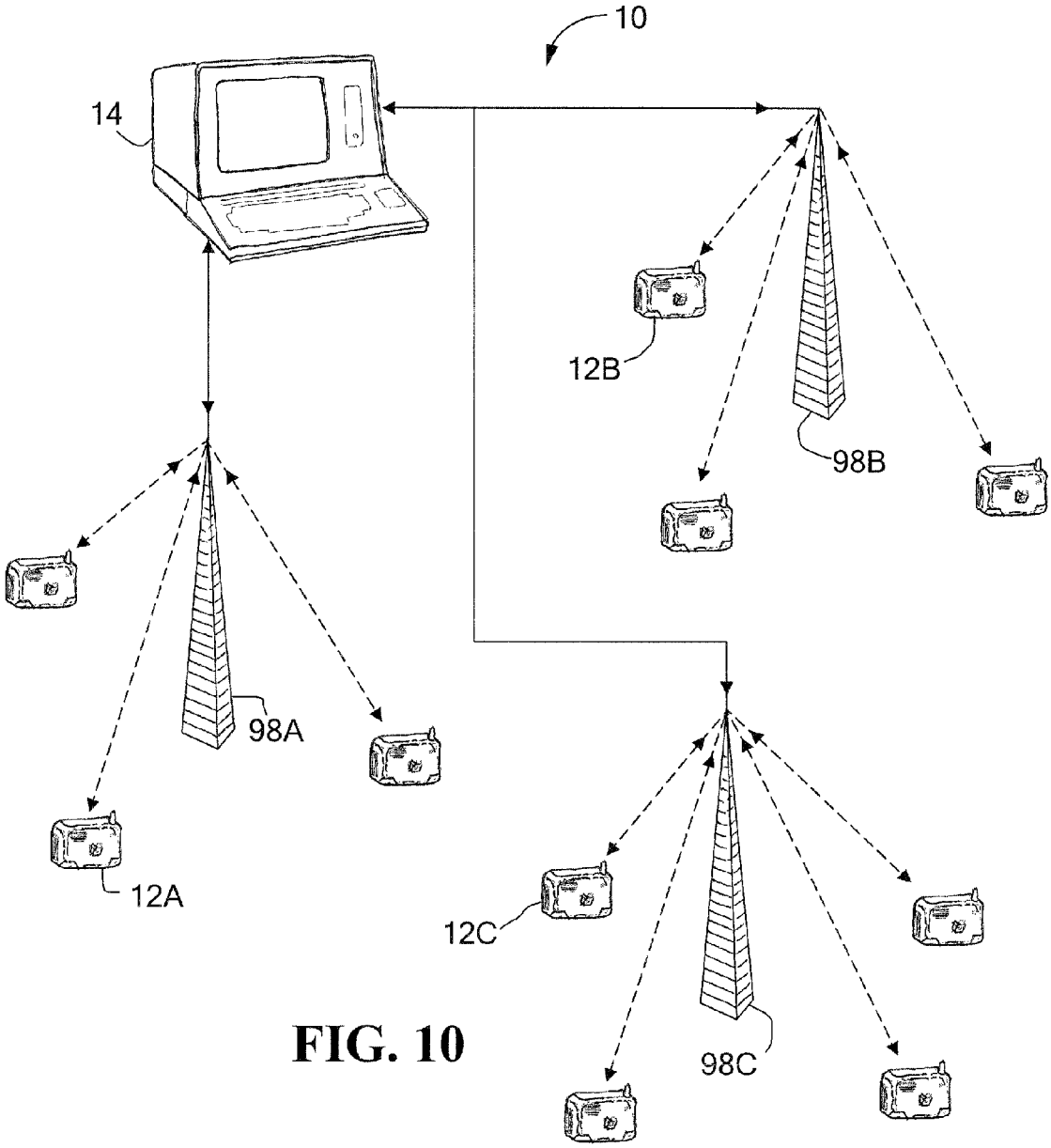
FIG. 10 is a block diagram of the alarm system of the present disclosure.

As indicated by FIG. 10, a plurality of alarm devices 12 may be installed in homes and other locations in residential and commercial areas in the geographic area 94 or township 92. Operators at one monitoring center may monitor one or more receivers 14, where each receiver 14 may monitor a plurality of alarm devices 12 installed in homes or other locations in the geographic area 94.

In the embodiment of FIG. 10, the alarm devices 12 include wireless alarm communication devices 18 connected to a wireless communication network comprising a plurality of wireless towers 98 operatively located throughout the township 92 or geographic area 94. Operators may monitor the one or more receivers 14 responding to alarm signals 30 that are sent to the receivers 14 over the wireless communication network. The receiver 14 may not be monitored by an operator in systems where the receiver 14 is configured to automatically respond to alarm signals 30.

The monitoring centers may use the alarm system 10 for delivering public service messages relevant to the geographic area 94. Operators at a monitoring center may use the receiver 14 to call a plurality of alarm devices 12 in a particular area by dialing the telephone numbers identifying the location of the alarm device 12. In this embodiment, the receiver 14 calls the telephone number and operatively transmits a voice message over the alarm speaker 78. Alternately, the message may be a text message provided on the alarm display screen 24. The text message may be accompanied by an audible alert, a light, or other indicator to notify persons that a message is on the display screen 24. The message may provide weather alerts such as a tornado, wildfire, or flood warning. The message may provide information about missing or kidnapped children. The message may provide school closings. It is contemplated that the receivers 14 may send any community service message to alarm devices in the area.

The alarm device 12 may further comprise a data input device 100 operatively connected to the alarm microprocessor 16 and alarm memory device 40. The data input device 100 may comprise a data port for operatively connecting to a computer or other device capable of configuring the alarm device 12 and transmitting data to and from the alarm device 12. Alternately, the data input device 100 may be a key pad such as on a telephone. In a further embodiment, the data input device 100 may be a touch screen configured for interacting with an operator. The data input device 100 may be any tactile, physical, electrical, wireless or wired, voice responsive, or other data input configuration known in the art.

The alarm device 12 may not have the telephone number until after the alarm device 12 is purchased by a consumer. At the time of purchase, a retailer or other operator may select the telephone number such that the telephone number identifies the location of an address provided by the purchasing consumer. Then, the retailer or other operator may program the alarm device 12 through the data input device 100 to configure the alarm device 12 for receiving calls on the communication network by the telephone number.

Alternately, a technician may install the alarm device 12 in a home or other location. When the technician installs the alarm device 12, the technician or other operator may select the telephone number such that the telephone number identifies the location of the address where the alarm device 12 will be installed. Then, the technician may program the alarm device 12 through the data input device 100 to configure the alarm device 12 for receiving calls on the communication network by the telephone number.

The alarm device 12 may have a global positioning device, or GPS device (not shown). The alarm device 12 with GPS may be configured with a telephone number or other identification code prior to installation. Then, when the device is installed, the alarm communication device 18 calls an automated, pre-determined telephone number for programming. During an automated programming step, the alarm device 12 identifies its installation address by transmitting its GPS coordinates.

The consumer may purchase the alarm device 12 in a retail store, and subsequently contact a service center by telephone or internet to receive a telephone number that identifies the location of an address provided by the purchasing consumer. Then, the consumer may follow instructions provided by the manufacturer or the service center to program the alarm device 12. In this embodiment, the consumer may connect the alarm device 12 to a computer or other computing device by the data input device 100 for configuring the device. The alarm device 12 may be configured for receiving calls on the communication network by the telephone number by using any technique known in the art.

While this invention has been described with reference to specific embodiments, it shall be understood that such description is by way of illustration and not by way of limitation. Accordingly, the scope and content of the present invention are to be defined only by the terms of the appended claims.

What is claimed is:

1. An alarm system comprising:

an alarm device positioned in a location, and a receiver positioned in a second location separate from the alarm device, the alarm device comprising:

one or more sensors operatively responding to a predetermined environmental indicator by providing a sensor signal identifying the responding sensor;

an alarm communication device connected to a communication network and having a telephone number for receiving calls on the communication network; and an alarm microprocessor operatively connected to the one or more sensors and the alarm communication device, where the alarm microprocessor uses the alarm communication device to call and operatively connect to the receiver after receiving the sensor signal and transmitting an alarm signal to the receiver correlating to the responding sensor, the receiver comprising:

a receiver communication device for connecting to the communication network and operatively connecting to the alarm communication device over the communication network; and a receiver microprocessor operatively connected to the receiver communication device, where the receiver microprocessor receives the alarm signal and identifies the location of the alarm device.

2. The alarm system according to claim 1, the alarm communication device being a telephone and the communication network being a telephone network.

3. The alarm system according to claim 1, the alarm communication device being a wireless telephone and the communication network being a wireless telephone network.

4. The alarm system according to claim 3, further comprising a household or wireless mobile telephone, the household or wireless mobile telephone comprising an alarm button and programmed to call and operatively connect to the receiver when the alarm button is pressed.

5. The alarm system according to claim 1, the receiver microprocessor being configured for identifying the location of the alarm device by the telephone number.

6. The alarm system according to claim 5, the telephone number comprising an area code plus seven digits, the seven digits indicating at least a geographic area within an area code area where the alarm device is located.

7. The alarm system according to claim 5, the receiver microprocessor being in communication with a database, the database associating the telephone number with at least an address where the alarm device is located.

8. The alarm system according to claim 1, the alarm signal comprising an identification code, and the receiver being configured for identifying the location of the alarm device by the identification code.

9. The alarm system according to claim 1, each sensor responding to an environmental indicator selected from a group consisting of smoke, carbon monoxide, carbon dioxide, ozone, temperature, and combustible gas.

10. The alarm system according to claim 1, the alarm device further comprising a radio receiver, and the alarm system further comprising:

an auxiliary alarm device positioned within a predetermined distance from the alarm device comprising:

one or more sensors operatively responding to a predetermined environmental indicator by providing a sensor signal identifying the responding sensor;

a radio transmitter having a transmission range at least the predetermined distance from the alarm device; and a microprocessor operatively connected to the one or more sensors and the radio transmitter, where the microprocessor uses the radio transmitter to send the sensor signal to the radio receiver;

the alarm microprocessor operatively receives the sensor signal and uses the alarm communication device to operatively connect to the receiver positioned in the second location.

11. The alarm system according to claim 1, the alarm communication device further comprising an alarm microphone and an alarm speaker; the receiver communication device further comprising a receiver microphone and a receiver speaker; and the alarm system further comprising:

the receiver microprocessor adapted to use the receiver communication device to call and operatively connect to the alarm device by dialing the telephone number and creating a voice communication channel between the alarm device and the receiver.

12. The alarm system according to claim 11, the receiver operatively transmitting a voice message over the alarm speaker.

13. The alarm system according to claim 1, the alarm device further comprising:

a camera providing a video signal;

the video signal being transmitted to the receiver when the alarm communication device and the receiver communication device are operatively connected.

14. The alarm system according to claim 13, the receiver further comprising a display device; and the alarm device further comprising:

the receiver microprocessor adapted to use the receiver communication device to call and operatively connect to the alarm device by dialing the telephone number, the receiver microprocessor receiving the video signal and displaying the video signal on the display device.

15. The alarm system according to claim 1, the alarm device further comprising an emergency light turning on when the alarm microprocessor receives the sensor signal.

16. A method of alerting emergency services comprising the steps of:

a. providing an alarm device comprising:

one or more sensors operatively responding to a predetermined environmental indicator by providing a sensor signal identifying the responding sensor;

an alarm communication device connected to a communication network and having a telephone number for receiving calls on the communication network; and an alarm microprocessor operatively connected to the one or more sensors and the alarm communication device, where the alarm microprocessor uses the alarm communication device to call and operatively connect to the receiver after receiving the sensor signal and transmitting an alarm signal to the receiver correlating to the responding sensor.

b. providing a receiver positioned in a second location separate from the alarm device comprising:

a receiver communication device for connecting to the communication network and operatively connecting to the alarm communication device over the communication network; and a receiver microprocessor operatively connected to the receiver communication device, where the receiver microprocessor receives the alarm signal and identifies the location of the alarm device;

c. sensing a predetermined environmental indicator using one or more sensors;

d. calling automatically from the alarm device a the receiver;

e. transmitting an alarm signal from the alarm device over the communication network to the receiver; and f. identifying the location of the alarm device by the telephone number.

17. The method according to claim 16, the step of calling automatically from the alarm device comprises calling from a wireless telephone on a wireless communication network.

18. The method according to claim 16, the step of selecting a telephone number for an alarm device comprising the step of:

encoding in the telephone number at least a geographic area within an area code area where the alarm device is located.

19. The method according to claim 16, further comprising the steps of: calling from the receiver the alarm device by dialing the telephone number; and listening from the receiver for sounds adjacent to the alarm device.

20. An alarm system comprising:

an alarm device positioned in a location, and a receiver positioned in a second location separate from the alarm device, the alarm device comprising:

a smoke detecting sensor operatively responding to a predetermined amount of smoke by providing a sensor signal;

a wireless alarm telephone comprising an alarm microphone and alarm speaker, being connected to a wireless communication network and having a telephone number for receiving calls on the wireless communication network, the telephone number identifying the location of the alarm device;

a camera providing a video signal;

an alarm microprocessor operatively connected to the smoke detecting sensor, the camera, and the wireless alarm telephone, where the alarm microprocessor uses the wireless alarm telephone to call and operatively connect to the receiver after receiving the sensor signal and sending an alarm signal and the video signal to the receiver; and an audible alarm within a range of about 80 to 120 decibels when the alarm microprocessor receives the sensor signal;

the receiver comprising:

a receiver communication device comprising a receiver microphone and receiver speaker, for connecting to the wireless communication network and operatively connecting to the wireless alarm telephone over the wireless communication network;

a display device;

a receiver microprocessor operatively connected to the receiver communication device and the display device, where the receiver microprocessor receives the alarm signal when the wireless alarm telephone and the receiver communication device are operatively connected, and identifies the location of the alarm device by the telephone number; and the receiver microprocessor uses the receiver communication device to call and operatively connect to the alarm device by dialing the telephone number and creating a communication channel between. the alarm device and the -receiver, receiving the video signal and displaying the video signal on the display device.

* * * * *